United States Patent [19]

Pancook

[11] Patent Number: 4,576,363

[45] Date of Patent: Mar. 18, 1986

[54] LEVER-OPERATED HOIST OR PULLER

[75] Inventor: James J. Pancook, Tonawanda, N.Y.

[73] Assignee: Columbus McKinnon Corporation, Amherst, N.Y.

[21] Appl. No.: 734,159

[22] Filed: May 15, 1985

[51] Int. Cl.[4] ..... B66D 1/30; B66D 1/48; B66D 3/12; B66D 5/22

[52] U.S. Cl. ..... 254/372; 188/72.8; 254/221; 254/378; 254/380

[58] Field of Search ..... 254/372, 373, 380, 382, 254/378, 221; 24/68 CD, 68 CT, 68 D, 71 ST, 71 CT; 188/72.8; 192/12 C, 19, 70, 94, 97

[56] References Cited

U.S. PATENT DOCUMENTS

| | | | |
|---|---|---|---|
| 2,835,946 | 5/1958 | Hume | 24/68 CT |
| 3,245,660 | 4/1966 | Ratcliff | 254/372 |
| 3,744,760 | 7/1973 | Uher | 192/19 |
| 4,348,011 | 9/1982 | Honda | 254/380 |

*Primary Examiner*—Billy S. Taylor
*Attorney, Agent, or Firm*—Bean, Kauffman & Bean

[57] ABSTRACT

A portable hoist or puller has two facing half shell members housing a chain sprocket rotatably affixed to a drive shaft supported for rotation by a pair of rollers. The first roller is slidably fixed for rotation with the drive shaft while the second is threaded to the shaft. The periphery of the threaded roller is serrated for engagement by a spring detent to inhibit its free rotation. Each roller has a hub portion extending outwardly of the housing to selectively receive a drive tool. A friction disc is disposed between each of the rollers and adjacent housing portion. To apply force to a load connected to the chain trained over the sprocket, the drive tool is coupled to the first roller and rotated causing the sprocket to feed the chain with the rollers pulled against the sprocket. If the drive tool released, the pull of the load tends to reversely rotate the shaft whereby the threaded arrangement causes the rollers to lock-up against the housing. To lower the load, the drive tool is coupled to the second roller and turned in the lowering direction. The shell members are retained together by a pair of upper bolts and single lower bolt. Attempts to overload the device cause elongation of the single lower bolt and resultant cocking of the housing shells so that the sides of the sprocket tend to dig into the housing to inhibit unsafe operation.

10 Claims, 12 Drawing Figures

Fig. 4.
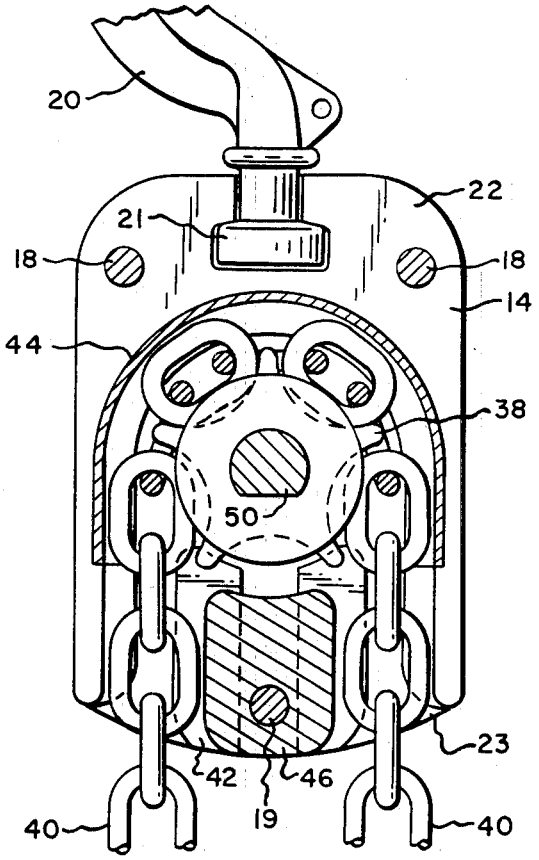
Fig. 5.
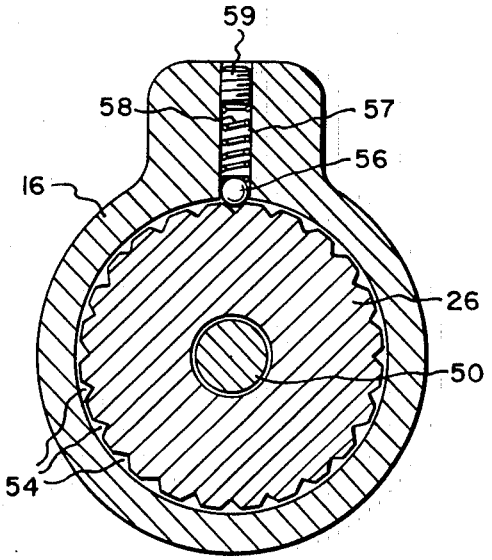
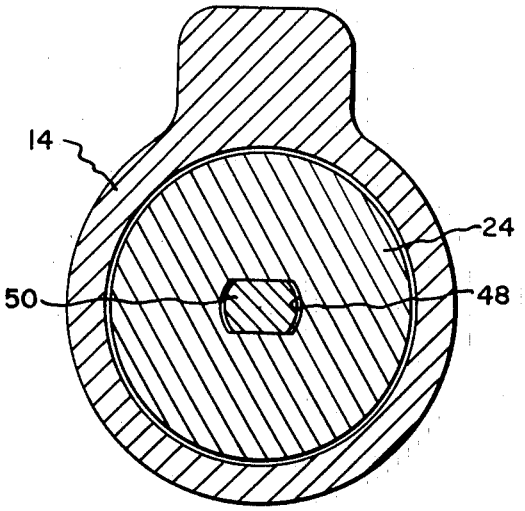
Fig. 6.
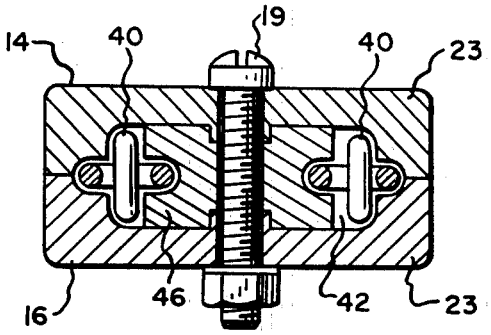
Fig. 7.

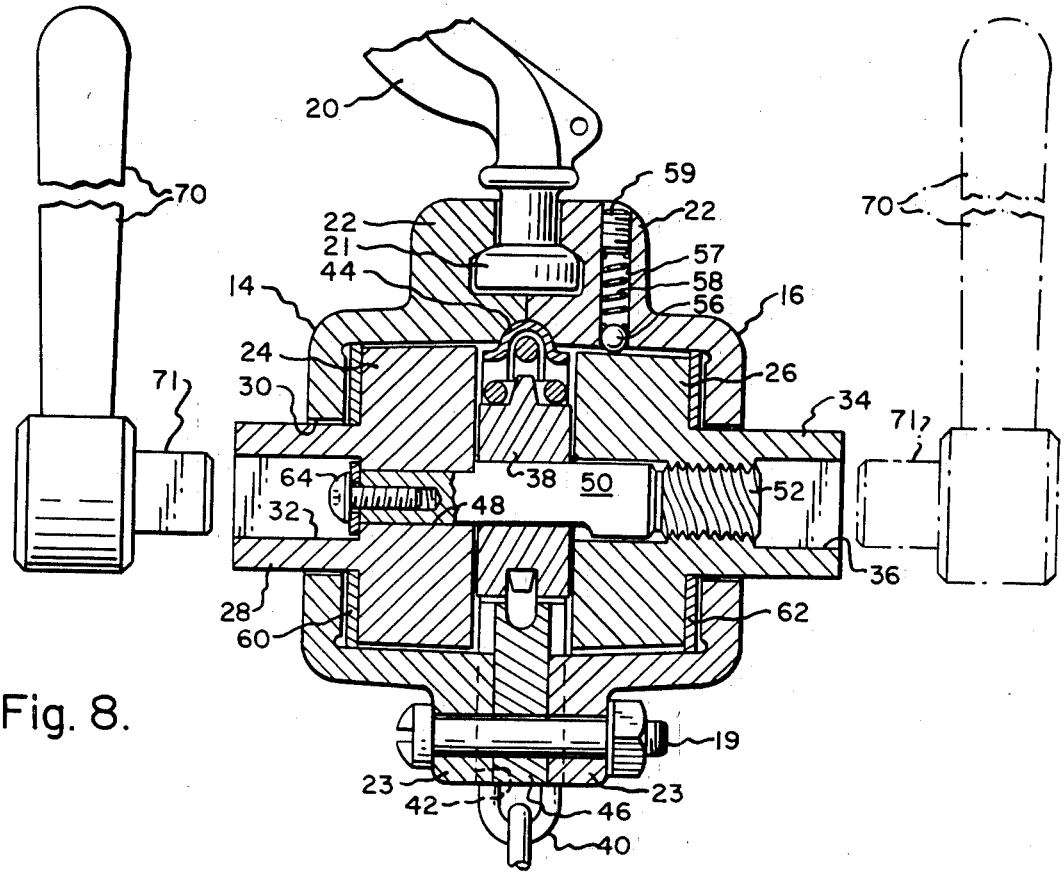
Fig. 8.
Fig. 9.
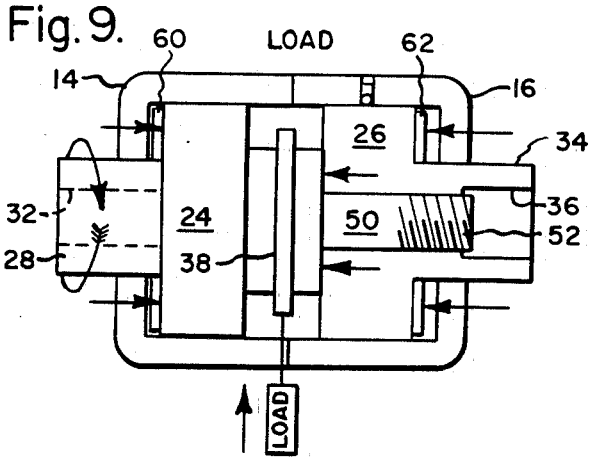
Fig. 10.
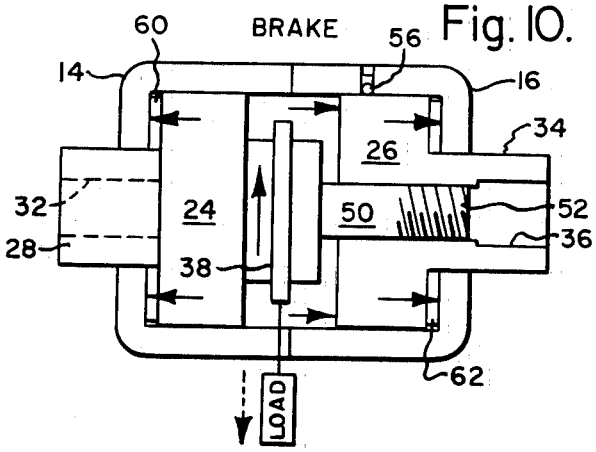
Fig. 11.
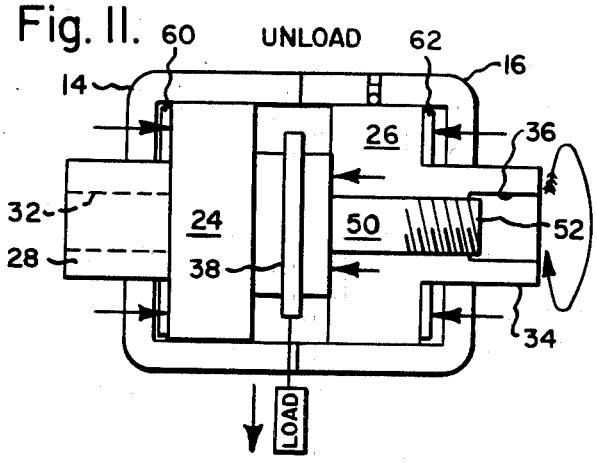
Fig. 12.
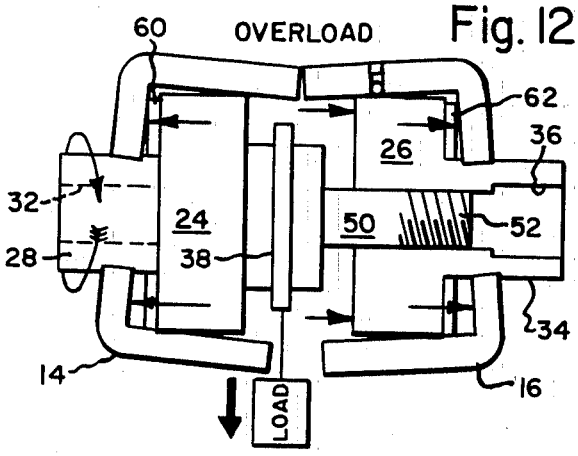

LEVER-OPERATED HOIST OR PULLER

BACKGROUND AND OBJECTS OF THE INVENTION

This invention relates to lever-operated hoists or "pullers" such as are sometimes referredto as "come-alongs". Such devices are manually operated for raising and lowering loads; tensioning wires or cables; and for otherwise pulling upon objects to be moved. Prior tools for such purposes are disclosed for example in U.S. Pat. Nos. 320,316; 1,684,185; 2,243,361; 2,493,727; 2,519,400; 2,608,107; 2,739,789; 3,056,480; 4,156,521 and 4,463,933. Devices for such purposes typically incorporate means whereby whenever the load is not being taken directly by the manually operated lever, it is sustained independently thereof by reason of automatic operation of a friction brake device.

The primary object of the present invention is to provide an improved basic design and constructin for such devices; and another object is to enable such devices to be made of substantially reduced size and weight compared to prior art devices of similar capacities. For example, in accordance therewith such tools may be of such small sizes as to be conveniently carried from job to job in a stndard type workman's tool box. Still another object of the invention is to provide a simplified and improved tool which is of such design and construction that the user is given ample warning whenever he is overloading the device, so as to avoid the incurrence of damage and/or danger to the user.

BRIEF DESCRIPTION OF THE DRAWINGS

FIG. 4 is a fragmentary sectional view taken as along line 4—4 of FIG. 1;

FIGS. 5 and 6 are fragmentary sectional views taken as along lines 5—5 and 6—6, respectively, of FIG. 1;

FIG. 7 is a sectional view taken as along line 7—7 of FIG. 3;

FIG. 8 is a fragmentary view taken asalong line 8—8 of FIG. 2;

FIG. 9 is a diagrammatic sectional view corresponding to FIG. 8 illustrating how the brake mechanism of the device automatically releases when the user operates it for raising or pulling upon an attached load;

FIG. 10 corresponds to FIG. 9, but illustrates how the brake mechanism automatically engages to hold the load in any suspended position when the user ceases such an operation;

FIG. 11 corresponds to FIGS. 9 and 10, but illustrates how the brake mechanism releases during a load lowering or releasing operation; and FIG. 12 is a schematic view corresponding to FIGS. 9, 10 and 11, illustrating how in event the user overloads the mechanism, the housing structure is deformed thereby providing a readily perceptive increase in resistance against further operation of the device.

DETAILED SPECIFICATION

Figure 1:
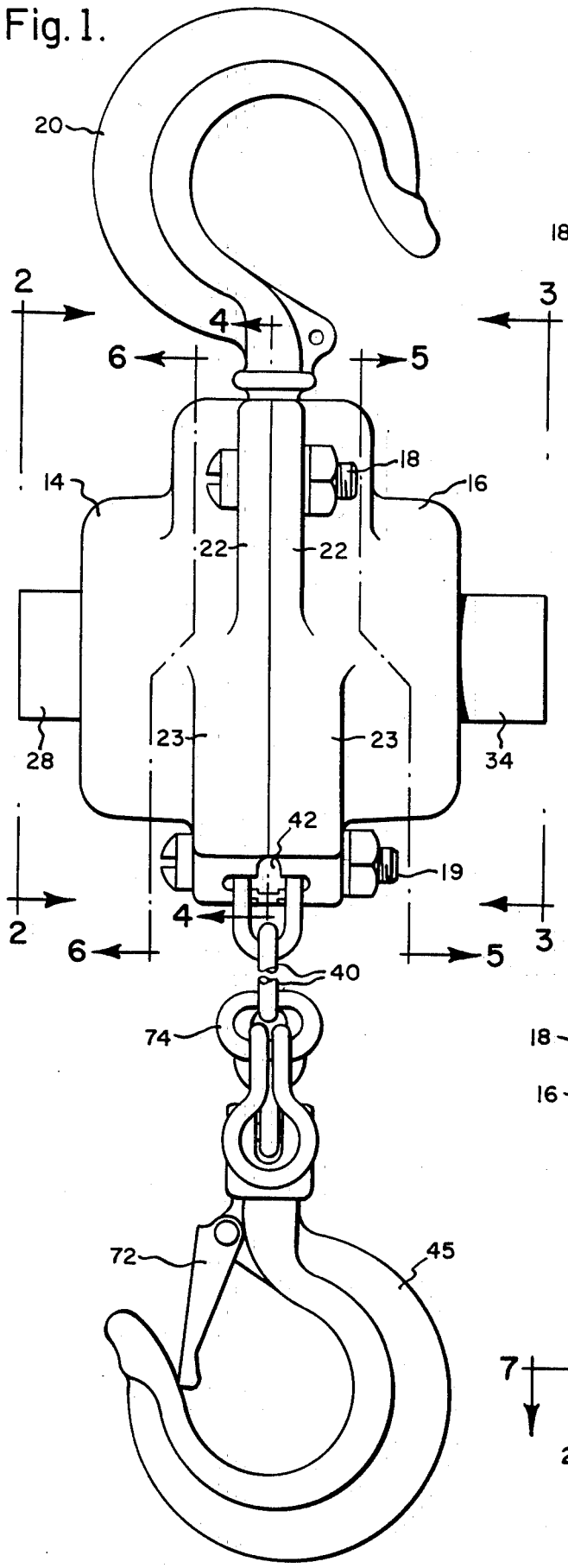
FIG. 1 is a side elevational view of a tool box sized "come-along", embodying a mechanism of the present invention; a load-chain; and hanger and load grappling hooks.

The invention is illustrated herein by way of a preferred example as being incorporated in a hoist or puller mechaism such as may be conveniently carried from job to job in a standard size/type workman's tool box. As shown, the mechanism includes a housing comprising two similarly shaped half-shell members 14,16, which are locked together by upper bolts 18,18 and a lower bolt 19. A mounting hook 20 is swivelably engaged between the upper portions of the housing members as shown at 21 (FIGS. 4 and 8). The housing members are each formed at their upper facing surfaces with flange portions 22,22 accommodating the bolts 18,18; and at their lower facing surfaces they include flanges 23,23 accommodating the locking bolt 19.

Figure 2:
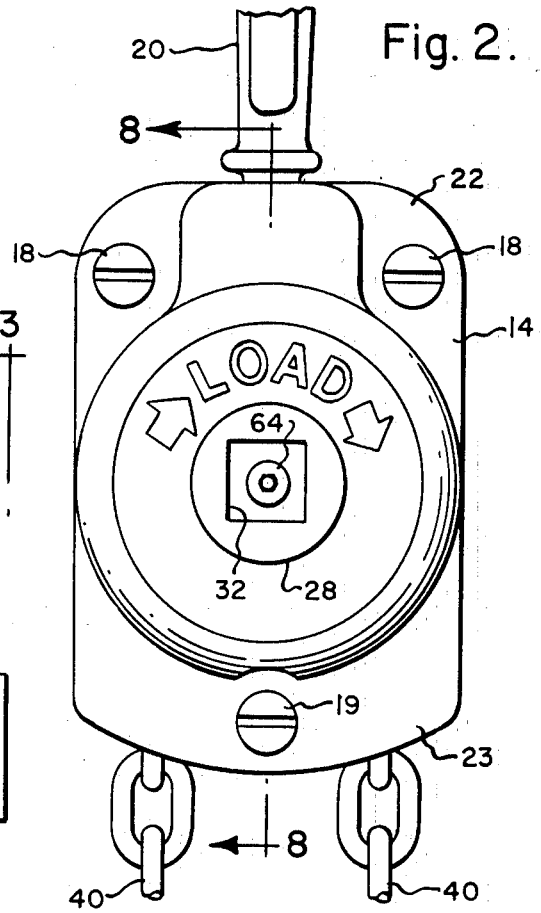
FIG. 2 is a fragmentary elevational view taken as along line 2—2 of FIG. 1.
Figure 3:
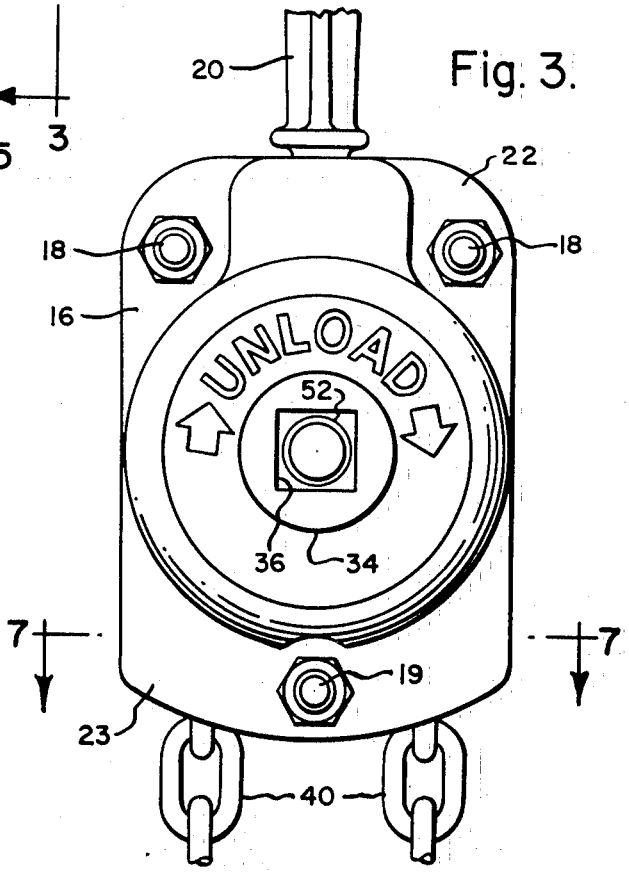
FIG. 3 is a fragmentary elevational view taken as along line 3—3 of FIG. 1.

The housng members 14,16 define internally thereof a cylindrical chamber which accommodates at one end thereof a roller 24 and at the other end thereof a roller 26. The roller 24 includes integrally therewith a cylindrical hub portion 28 which extends through a suitably apertured wall portion 30 of the housing shell 14, and as shown in FIGS. 2, 3 and 8 is square-socketed as shown at 32. The roller 26 similarly includes a hub portion 34 which extends through a suitably apertured end wall portion of the housing shell 16 and is square-socketed as shown at 36. The load "lift" or "pull" wheel 38 about which the load chain 40 trains is nested between the inside opposite ends of the rollers 24,26; and the housing is suitably apertured as shown at 42 (FIGS. 1, 4 and 8) so as to permit the chain 40 to travel in and out of the housing and around the wheel 38. A chain guide 44 (FIGS. 4 and 8) is slide-fitted into the upper part of the housing and over the chain, and a chain divider or "stripper" block 46 is carried by the bolt 19 in the center of the chain outlet 42. A load "grab hook" such as shown at 45 is carried by one end of the chain 40, and a spring-biased latch as shown at 72 is preferably provided to prevent unintended escape of the load from the hook, as is well known in the art.

The roller 24 is machined to include a double-D-shaped bore 48 (FIGS. 6 and 8) into which slip fits in keyed relation therewith the complementarily shaped end portion of a drive shaft 50. The central portion of the shaft 50 is machined to a "D" sectioned configuration (FIG. 4) and slide fits in keyed relation into a similarly shaped bore through the center of the lift wheel 38. At its other end, the shaft 50 is screw threaded as shown at 52 (FIGS. 8–12) and engages thereat in threaded relation with an internally threaded portion of the roller 26. The outer periphery of the roller 26 is serrated as shown at 54 (FIGS. 5 and 8) for cooperation with a detent ball 56 which is carried withn a bore 57 in the housing member 16 and is biased against the serrations 54 by means of a spring 58 and lock screw 59. Friction discs 60, 62 are disposed between opposite wall portions of the roller 24 and the housing shell 14, and between the roller 26 and the shell 16, respectively.

When assembling the mechanism, the drive shaft 50 is first slip-fitted through the lift wheel 38 and then screw threaded into the roller 26. The roller 24 is then slip-fitted upon the shaft 50 and locked thereto by means of a machine screw 64. The brake discs 60,62 are then slip-fitted into position over the hubs 28,34. The chain 40 is then trained about the lift wheel 38 and the chain guide 44 is then positioned upon the chain 40. The housing half shells are then slide fitted upon the hubs 28,34 while the swivel headed portion of the hook 20 is disposed therebetween. The upper bolts 18,18 are then placed in position to lock the two housing parts together, and the chain stripper block is then positioned between the shells and the assembly completed by placement of the bolt 19. The detent ball 56 is then dropped into the bore 57 and locked therein by means of the spring 58 and set screw 59.

As illustrated at 70 (FIG. 8), the tool may be operated by means of a lever having a polygonally sectioned boss 71 extending laterally at one end thereof for selective engagement with the sockets 32,36. For example, in order to raise or otherwise pull upon a load, the lever boss is inserted into the socket 32. Then, upon rotation of the lever in clockwise direction (as viewed from the left hand side of the mechanism as shown in FIG. 8) the drive shaft 50 will thererby be driven by the screw thread system 52 to displace both rollers inwardly of the mechanism toward the lift wheel and away from the housing end walls and the friction discs 60,62, while the lift wheel is rotating in such direction as to raise or pull upon the load. Upon attainment of the desired height or other position of the load and cessation of lever rotation by the operator, the residual pull by the load tends to rotate the lift wheel slightly in reverse direction. Because of the detent action of the ball 56 against the serrated portion 54 of the roller 26, the drive shaft 50 is thereupon caused to screw-thread retract slightly relative to the roller 26. This action causes the rollers 24,26 to move away from the lift wheel and to press the friction discs 60,62 against the end walls of the housing shell members 14,16, thereby locking the device against any unintended lowering or "unloading" of the load.

However, for intended release (or lowering) of the load, the operator shifts the lever 70 into the socket 36 of the roller 26, and then rotates it in clockwise direction (as viewed from the right hand side thereof). This causes the roller 26 to screw thread on the drive shaft 50 toward the left as viewed in FIG. 8, thereby releasing the previously established friction brake holding action and permitting the operator to assist gravity (if necessary) to lower the load.

As shown at 74 the free end of the chain 40 terminates in a "stop link" which is of such size as to be unable to pass through the chain outlet 42 (FIGS. 4 and 7). This is to prevent the chain from becoming unintentionally disassembled from the device, and also provides means whereby the user of the tool may conveniently and rapidly take up any slack in the load chain when the grab hook is attached to the load.

Thus, it will be appreciated that the mechanism of the invention is of unique design and construction, whereby a hoist or puller may be provided which is of substantially reduced size and weight, while being of equal capacity compared to prior art mechanisms from similar purposes.

However, it is another feature of the invention that in the event the user subjects the device to an overload, the lower housing shell interlock bolt 19 initially elongates. This is due to the pressures exerted by the rollers 24,26 in opposite directions against the end walls of the shells 14,16, whereupon the lower portions of the shells are allowed to separate and the shells become plastically deformed as is exaggeratedly illustrated by FIG. 12. This causes the shells 14,16 to "cock" relative to the rollers, whereby the rollers tend to "dig" into the shells which increases the resistance against operation of the device. This effect becomes immediately apparent to the user prior to any mechanical ruptures of the device such as otherwise might have dangerous results.

It is still another feature of this invention that the housing shell portions 14,16 and the rollers 24,26 in each case may be fashioned from duplicate stock pieces, thereby providing for economical manufacture thereof. Whereas the drive shaft 50; the lift wheel 38, and the chain guide 44 are preferably formed of high strength steel or the like, the rollers 24,26 and the housing shells 14,16 may be die cast, molded or forged of any suitable metal or fiberglass or phenolic impregnated fabric laminate, or the like. Whereas the means for locking housing half shells together are shown in the drawing herewith as being of the standard machine bolt type, in lieu thereof machine screws may be employed. Use for this purpose of screw threaded locking means permits, if necessary, opening of the device for internal parts repair/replacement and/or inspection and the like.

It is also to be understood that in lieu of using a standard type socket wrench as shown at 70 (FIG. 8) a ratchet type socket wrench may be employed in connection with the form of the invention as is shown in FIGS. 2, 3 and 8. In such case, the ratchet wrench may be similarly engaged in the sockets 32,36, and then oscillated so as to "ratchet" the load lift wheel to rotate in the desired direction. Thus, the user is not required to continuously rotate the operating handle, as when a standard type socket wrench is employed. Furthermore, it is to be noted that the hub portions 28,34 of the rollers 24,26, instead of being formed as shown in FIG. 8, may be externally of a peripherally polygonal shape, so as to accommodate for similar puposes employment of either a standard type "box" or ratchet type "box" wrench.

What is claimed is:

1. A lever-operated type chain hoist or load puller comprising a housing having a support hook extending therefrom and a drive shaft rotatably mounted in said housing and carrying a load engaging sprocket wheel thereon and a load chain passing in and out of said housing and training over said sprocket wheel for load hoisting and lowering and/or pulling in response to reverse rotations of said shaft, the improvement comprising:

said housing being composed of a pair of oppositely facing half shell members having means locking them together at upper and lower opposite flange portions thereof and defining interiorly thereof a cylindrical chamber with said drive shaft and sprocket wheel being disposed centrally therein;

a pair of rollers disposed within said chamber at opposite sides of said sprocket wheel, said rollers having hub portions extending in rotatable relation through apertured end wall portions of said shell members, and washer-shaped friction discs encompassing said hub members interiorly of said chamber and being thereby positioned between outside surfaces of said rollers and inside end surfaces of said housing shell members;

one of said rollers being keyed to one end of said drive shaft, and the other of said rollers being screw-threaded upon the other end of said drive shaft;

the outer extending end portions of said hubs being shaped to accommodate detachable engagements therewith externally of said housing by means of a wrench type lever or the like.

2. A lever-operated hoist or puller as set forth in claim 1, wherein said means locking said half shell members together comprises a plurality of screw threaded fasteners at positions radially extended away from said drive shaft.

3. A lever-operated hoist or puller as set forth in claim 2, wherein said fasteners are relatively grouped peripherally of said device so as to provide separate concentrations of holding power at diammetrically opposed relation to said shaft.

4. A lever-operated hoist or puller as set forth in claim 3, wherein the more highly concentrated holding power is at the suspension hook end of said housing.

5. A lever-operated hoist or puller as set forth in claim 1, wherein said shell members cooperate to mount a chain guide device encompassing that portion of the load chain which trains over said sprocket wheel.

6. A lever-operated hoist or puller as set forth in claim 5, wherein said half shell members are apertured at the load chain inlet/outlet portions thereof and accommodate therebetween a chain stripper device.

7. A lever-operated hoist or puller as set forth in claim 1, wherein the roller which is screw-threaded upon said drive shaft is peripherally serrated, and spring biased detent means are carried by one of said shell members to engage the serrated portion of said roller, thereby resisting freewheeling of said roller relative to said housing.

8. A lever-operated hoist or puller as set forth in claim 1, wherein said hub portions extending outside of said housing are shaped to accommodate in slip-fitted relation a lever-like hoist operating tool for rotating said drive shaft.

9. A lever-operated hoist or puller as set forth in claim 1, wherein said hubs are socketed to receive in slip-fitted relation a socket wrench type hoist operating tool.

10. A lever-operated hoist or puller as set forth in claim 1, wherein the outwardly extendig hub portions are externally shaped to accommodate in slip-fitted relation thereon a box wrench type hoist operating tool.

* * * * *